US008581800B2

(12) United States Patent
Suematsu et al.

(10) Patent No.: US 8,581,800 B2
(45) Date of Patent: Nov. 12, 2013

(54) MILLIMETER WAVE RECEPTION DEVICE, MOUNTING STRUCTURE FOR MILLIMETER WAVE RECEPTION DEVICE, AND MILLIMETER WAVE TRANSMISSION/RECEPTION DEVICE

(75) Inventors: Eiji Suematsu, Osaka (JP); Hiroyuki Suga, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 413 days.

(21) Appl. No.: 12/963,686

(22) Filed: Dec. 9, 2010

(65) Prior Publication Data

US 2011/0140984 A1 Jun. 16, 2011

(30) Foreign Application Priority Data

Dec. 10, 2009 (JP) ..... 2009-280757

(51) Int. Cl.
*H01Q 13/00* (2006.01)

(52) U.S. Cl.
USPC ..... 343/872; 343/753

(58) Field of Classification Search
USPC ..... 343/872, 753
See application file for complete search history.

(56) References Cited

U.S. PATENT DOCUMENTS

| | | | | |
|---|---|---|---|---|
| 3,576,581 | A * | 4/1971 | Tricoles et al. | 343/872 |
| 6,049,305 | A * | 4/2000 | Tassoudji et al. | 342/357.76 |
| 7,397,442 | B2 * | 7/2008 | Hawes | 343/872 |
| 2005/0099338 | A1 | 5/2005 | Noro et al. | |
| 2009/0219903 | A1 | 9/2009 | Alamouti et al. | |
| 2012/0249611 | A1 | 10/2012 | Shibata et al. | |

FOREIGN PATENT DOCUMENTS

| | | | |
|---|---|---|---|
| JP | 2-270404 | A | 11/1990 |
| JP | 11-88028 | A | 3/1999 |
| JP | 3082946 | U | 10/2001 |
| JP | 2002-246832 | A | 8/2002 |
| JP | 2005-5980 | A | 1/2005 |
| JP | 2005-203978 | A | 7/2005 |
| JP | 2007-43284 | A | 2/2007 |
| JP | 2009-17581 | A | 1/2009 |
| JP | 2 037 531 | A1 | 3/2009 |
| JP | 2009-284287 | A | 12/2009 |
| JP | 2010-74276 | A | 4/2010 |

OTHER PUBLICATIONS

Japanese Office Action mailed Apr. 24, 2012 with English Translation.

"Countermeasures against Snow Accretion on and Snow Shedding from Road Signposts", Snow Ice Team, Monthly Report of the Civil Engineering Research Institute for Cold Region, No. 658, Mar. 2008, pp. 45-48.

* cited by examiner

*Primary Examiner* — Tan Ho
(74) *Attorney, Agent, or Firm* — Birch, Stewart, Kolasch & Birch, LLP

(57) ABSTRACT

A millimeter wave reception device includes a base member, an antenna portion placed on an upper surface of the base member, and a cover arranged above the antenna portion to cover the antenna portion. The antenna portion is arranged within a space formed by the upper surface of the base member and an inner surface of the cover. The cover is formed in a tapered shape, and includes not less than one inclined surface having a constant gradient such that the space becomes narrower at a position closer to an upper portion. An angle formed between the inclined surface of the cover and the upper surface of the base member is not less than 60° and not more than 90°.

8 Claims, 11 Drawing Sheets

MILLIMETER WAVE RECEPTION DEVICE, MOUNTING STRUCTURE FOR MILLIMETER WAVE RECEPTION DEVICE, AND MILLIMETER WAVE TRANSMISSION/RECEPTION DEVICE

This nonprovisional application is based on Japanese Patent Application No. 2009-280757 filed on Dec. 10, 2009 with the Japan Patent Office, the entire contents of which are hereby incorporated by reference.

BACKGROUND OF THE INVENTION

1. Field of the Invention

The present invention relates to a millimeter wave reception device, a mounting structure for a millimeter wave reception device, and a millimeter wave transmission/reception device. In particular, the present invention relates to a millimeter wave reception device, a mounting structure for a millimeter wave reception device, and a millimeter wave transmission/reception device installed outdoors.

2. Description of the Background Art

Japanese Patent Laying-Open Nos. 2009-017581 and 2005-005980 are prior documents disclosing a television community reception system and a transmission/reception device utilizing a millimeter wave communication system. Since broadcast signals are wirelessly distributed to households in the television community reception system and the transmission/reception device described in Japanese Patent Laying-Open Nos. 2009-017581 and 2005-005980, there is no need to provide a distributor and a long coaxial cable for signal transmission.

FIG. 11 is a view schematically showing a mounting structure for a conventional millimeter wave transmission/reception device. As shown in FIG. 11, in a conventional millimeter wave transmission/reception device 33, a millimeter wave transmission device 31 is arranged on a lower surface of a tip of an arm 34 provided to protrude laterally from a roof of a building 38. Millimeter wave transmission device 31 is set to transmit radio waves 37 downward. Radio waves 37 transmitted from millimeter wave transmission device 31 have directivity, and propagate downward while spreading slightly as shown in FIG. 11.

On the other hand, a millimeter wave reception device 32 is arranged on an upper surface of a tip of an arm 35 provided to protrude laterally from a balcony 36 of each floor. A plurality of millimeter wave reception devices 32 are each arranged to face millimeter wave transmission device 31. Millimeter wave reception device 32 is provided with an antenna portion receiving radio waves 37.

The antenna portions of the plurality of millimeter wave reception devices 32 are arranged in a region in which radio waves 37 reach, and are arranged such that, when the antenna portions are projected in a direction in which radio waves 37 are transmitted, the antenna portions do not overlap each other. As the antenna portion, a planar antenna, a lens antenna, a horn antenna, or the like is used. In millimeter wave reception device 32 installed outdoors, the antenna portion is housed within a hemispherical cover made of a material having weather resistance to suppress deterioration of the antenna portion.

FIG. 12A is a top view schematically showing a structure of a conventional millimeter wave reception device. FIG. 12B is a cross sectional view schematically showing the structure of the conventional millimeter wave reception device. In FIG. 12B, for convenience of explanation, millimeter wave transmission device 31 is also shown schematically.

As shown in FIGS. 12A and 12B, in conventional millimeter wave reception device 32, a lens antenna 39 is arranged on an upper surface of a base member 43. A hemispherical cover 40 is provided above lens antenna 39. An output terminal 41 is provided on a side surface of base member 43. Output terminal 41 is connected to lens antenna 39 through a circuit board 42*a*, an antenna-integrated circuit element 42*b*, and a circuit not shown.

An apex portion 39*a* and a central portion 39*b* of lens antenna 39 are arranged to be located on an identical straight line in a vertical direction. Apex portion 39*a* and central portion 39*b* of lens antenna 39 are arranged to be located within the region in which radio waves 37 transmitted from millimeter wave transmission device 31 reach. A region between arrows indicated by two broken lines shown in FIG. 12B represents the region in which radio waves 37 reach.

Since millimeter wave reception device 32 is installed outdoors, it is exposed to wind and rain. When rain sticks to or snow is accumulated on an upper surface of the antenna portion of millimeter wave reception device 32, reception propagation loss of radio waves 37 occurs at the antenna portion. When hemispherical cover 40 is mounted above the antenna portion, rain or snow failing on cover 40 is likely to accumulate in the vicinity of a top portion of cover 40 because the top portion of cover 40 has a low inclination.

Since the apex portion and the central portion of the antenna portion are located below the top portion of cover 40, accumulation of rain or snow in the vicinity of the top portion of cover 40 results in an increase in the reception propagation loss of radio waves 37 at the antenna portion, causing a situation where wireless transmission cannot be performed. In addition, when cover 40 has a gently sloping shape such as a hemispherical shape, a bird, an insect, or the like readily lands on cover 40. Also when a bird, an insect, or the like lands on cover 40, the reception propagation loss of radio waves 37 at the antenna portion is increased, causing a situation where wireless transmission cannot be performed.

SUMMARY OF THE INVENTION

One object of the present invention is to provide a millimeter wave reception device, a mounting structure for a millimeter wave reception device, and a millimeter wave transmission/reception device in which reception propagation loss of radio waves can be reduced by causing rain or snow to be less likely to accumulate on a cover, and causing a bird, an insect, or the like to be less likely to land on the cover.

A millimeter wave reception device based on the present invention includes a base member, an antenna portion placed on an upper surface of the base member, and a cover arranged above the antenna portion to cover the antenna portion. The antenna portion is arranged within a space formed by the upper surface of the base member and an inner surface of the cover. The cover is formed in a tapered shape, and includes not less than one inclined surface having a constant gradient such that the space becomes narrower at a position closer to an upper portion. An angle formed between the inclined surface of the cover and the upper surface of the base member is not less than 60° and not more than 90°.

According to the configuration described above, the cover including an inclined surface with a steep gradient and formed in a tapered shape that is more narrowed at a position closer to an upper portion is arranged above the antenna portion, thereby causing rain or snow to be less likely to accumulate on the cover, and causing a bird, an insect, or the like to be less likely to land on the cover. As a result, reception propagation loss of radio waves at the antenna portion can be reduced, and good wireless transmission can be performed. Here, "tapered" means "narrowed toward one end" as described in Kojien (one of the largest Japanese dictionaries), and the cover is formed to be continuously narrowed from a foot portion to a top portion.

In one form of the present invention, the cover is formed in a hollow conical shape or a hollow pyramid shape. According to the configuration described above, the top portion of the cover has a peak shape, which can prevent a bird or an insect from landing on the top portion of the cover.

Preferably, a bifurcation portion causing a liquid sticking to an outer surface of the cover to flow from a top portion of the cover to a foot portion of the cover in a bifurcated manner is formed on the outer surface of the cover. According to the configuration described above, by causing rain, snowmelt, or the like sticking to the outer surface of the cover to flow along the bifurcation portion in a dispersed manner, rain, snowmelt, or the like can be discharged efficiently.

In one form of the present invention, the bifurcation portion in which convex portions or concave portions are spaced from each other is formed on the outer surface of the cover radially over an entire periphery from the top portion of the cover to the foot portion of the cover. With the configuration described above, by causing rain, snowmelt, or the like sticking to the outer surface of the cover to flow along the bifurcation portion, surface tension on the outer surface of the cover can be reduced, and reception propagation loss of radio waves at the antenna portion due to rain or snowmelt can be reduced.

In one form of the present invention, a plurality of the bifurcation portions in a Λ-shape in which convex portions or concave portions are spaced from each other are formed on the outer surface of the cover. With the configuration described above, by causing rain, snowmelt, or the like sticking to the outer surface of the cover to flow along the bifurcation portion in a dispersed manner, rain, snowmelt, or the like can be discharged efficiently. As a result, surface tension on the outer surface of the cover can be reduced, and reception propagation loss of radio waves at the antenna portion due to rain or snowmelt can be reduced.

In one form of the present invention, the cover includes two inclined surfaces each formed of a plane, and the two inclined surfaces cross each other to form an angle of more than 0° and not more than 60°. With the configuration described above, the top portion of the cover has a pointed shape, which can suppress a bird or an insect from landing on the top portion of the cover.

Preferably, a heater heating the cover is provided. With the configuration described above, snow falling on the cover can be melted and caused to flow.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, a millimeter wave reception device, a mounting structure for a millimeter wave reception device, and a millimeter wave transmission/reception device in accordance with Embodiment 1 based on the present invention will be described with reference to the drawings.

Embodiment 1

Figure 1:
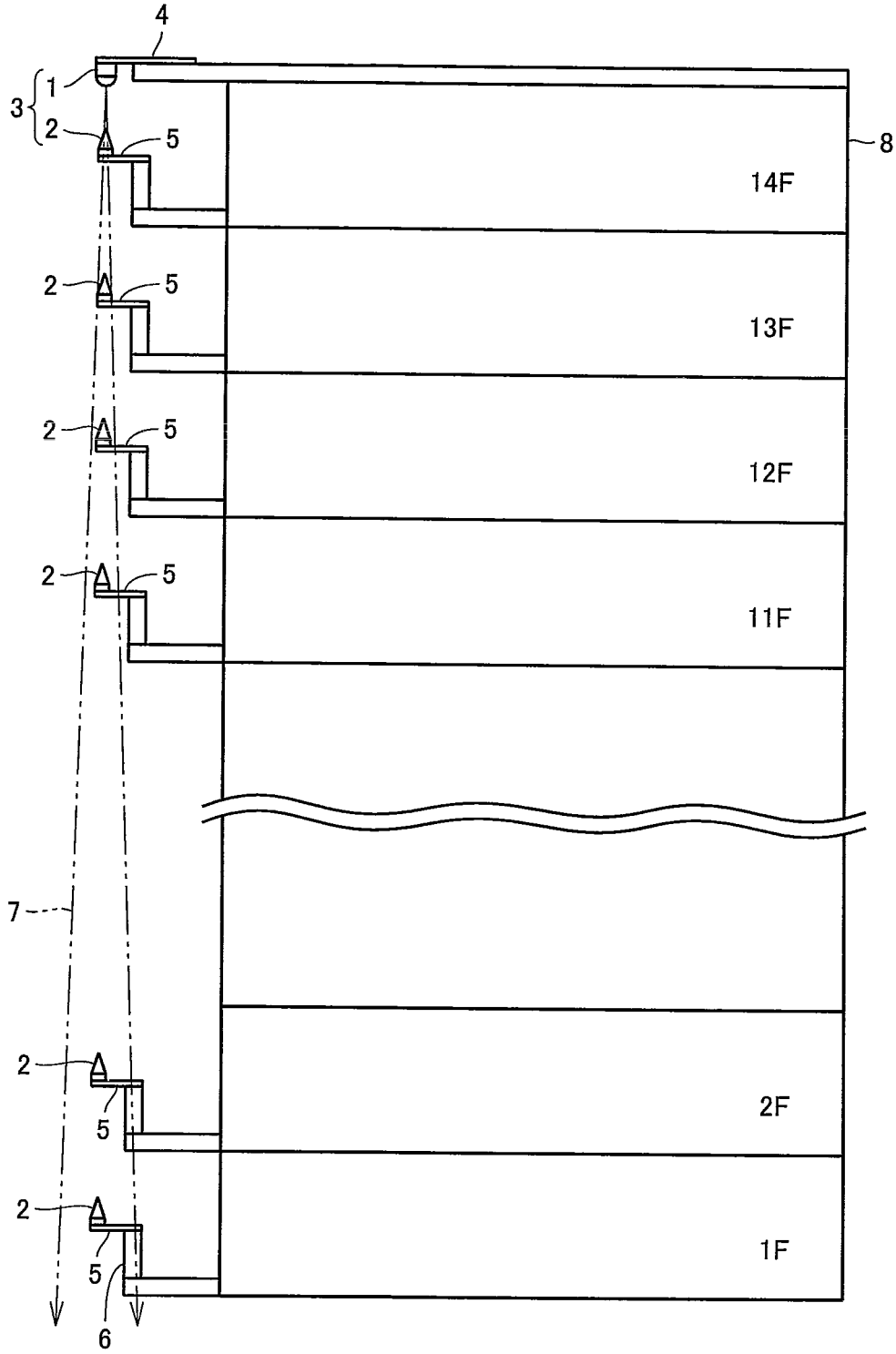
FIG. 1 is a view schematically showing a mounting structure for a millimeter wave transmission/reception device in accordance with Embodiment 1 of the present invention.

FIG. 1 is a view schematically showing a mounting structure for a millimeter wave transmission/reception device in accordance with Embodiment 1 of the present invention. As shown in FIG. 1, in a millimeter wave transmission/reception device 3 in accordance with the present embodiment, a millimeter wave transmission device 1 is arranged on a lower surface of a tip of an arm 4 provided to protrude laterally from a roof of a building 8. Millimeter wave transmission device 1 is set to transmit radio waves 7 downward. Radio waves 7 transmitted from millimeter wave transmission device 1 have directivity, and propagate downward while spreading slightly as shown in FIG. 1. Millimeter wave transmission/reception device 3 in accordance with the present embodiment performs wireless transmission in a millimeter wave band of a 60 GHz band.

On the other hand, a millimeter wave reception device 2 is arranged on an upper surface of a tip of an arm 5 provided to protrude laterally by tens of centimeters from a balcony 6 of each floor. A plurality of millimeter wave reception devices 2 are each arranged to face millimeter wave transmission device 1. Millimeter wave reception device 2 is provided with an antenna portion receiving radio waves 7.

The antenna portions of the plurality of millimeter wave reception devices 2 are arranged in a region in which radio waves 7 reach, and are arranged such that, when the antenna portions are projected in a direction in which radio waves 7 are transmitted, the antenna portions do not overlap each other. Although a lens antenna is used as the antenna portion in the present embodiment, a planar antenna, a horn antenna, and the like may be used.

Figure 2A:
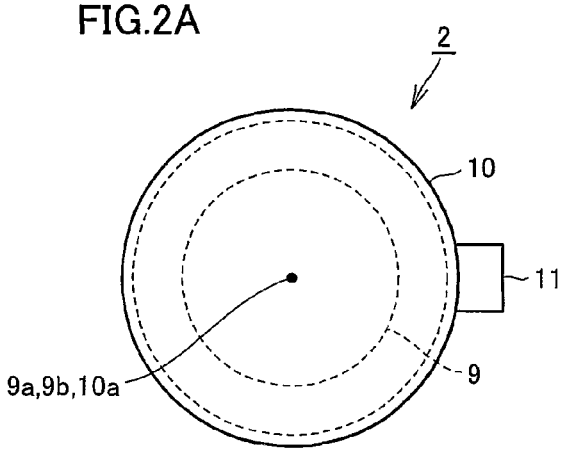
FIG. 2A is a top view schematically showing a structure of a millimeter wave reception device of the same embodiment.
Figure 2B:
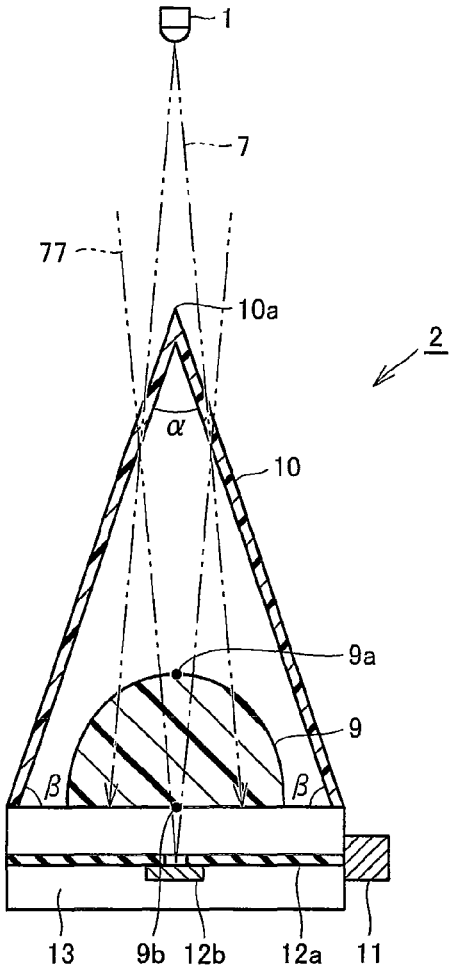
FIG. 2B is a cross sectional view schematically showing the structure of the millimeter wave reception device of the same embodiment.
Figure 3:
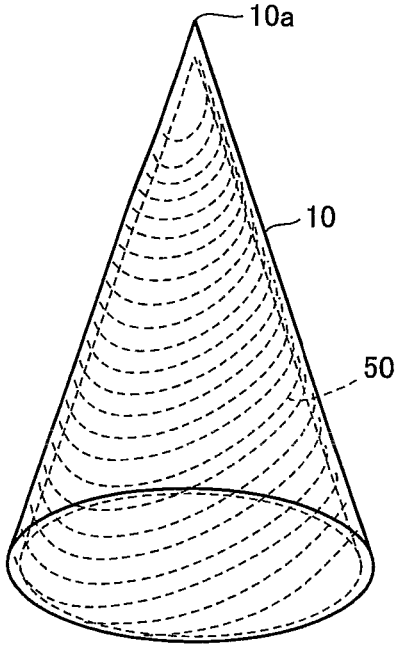
FIG. 3 is a perspective view schematically showing a cover in accordance with the same embodiment.

FIG. 2A is a top view schematically showing a structure of a millimeter wave reception device of the present embodiment. FIG. 2B is a cross sectional view schematically showing the structure of the millimeter wave reception device of the present embodiment. In FIG. 2B, for convenience of explanation, millimeter wave transmission device 1 is also shown schematically. FIG. 3 is a perspective view schematically showing a cover in accordance with the present embodiment.

As shown in FIGS. 2A and 2B, in millimeter wave reception device 2 in accordance with the present embodiment, a lens antenna 9 is placed on an upper surface of a base member 13. A cover 10 is arranged above lens antenna 9 to cover lens antenna 9. Lens antenna 9 is arranged within a space formed by the upper surface of base member 13 and an inner surface of cover 10.

An output terminal 11 is provided on a side surface of base member 13. Output terminal 11 is connected to lens antenna 9 through a circuit board 12*a*, an antenna-integrated circuit element 12*b*, and a circuit not shown. A wireless signal received by lens antenna 9 is amplified and down-converted by the circuit described above, and is output from output terminal 11.

As shown in FIG. 3, cover 10 in accordance with the present embodiment is formed in a hollow conical shape. Therefore, cover 10 is formed in a tapered shape, and includes one inclined surface having a constant gradient such that the space described above becomes narrower at a position closer to an upper portion.

Here, it is assumed that $\beta$ indicates an angle formed between the inclined surface of cover 10 and the upper surface of base member 13, and $\alpha$ indicates an angle on an inner surface side of the inclined surface at a top portion 10*a* of cover 10. Since $\beta$ is set to an angle of not less than 60° and not more than 90°, $\alpha$ is not more than 60°. Although top portion 10*a* of cover 10 is pointed in the present embodiment, it may have some roundness.

As described in Anti-Icing in section 4.1, Monthly Report of the Civil Engineering Research Institute for Cold Region, No. 658, March 2008, snow is less likely to stick to an inclined surface having a gradient of not less than 60°. Therefore, with cover 10 in which $\beta$ is set to an angle of not less than 60° and not more than 90°, snow falling on cover 10 can readily slide off cover 10.

In addition, top portion 10*a* of cover 10 has a pointed shape by setting a to not more than 60°, which can prevent a bird, an insect, and the like from landing on top portion 10*a* of cover 10.

As a material for cover 10, polypropylene having weather resistance is used. Further, the thickness of cover 10 is set to not less than 1 mm and not more than 2 mm so as not to reduce intensity of receiving radio waves 7 at lens antenna 9.

It is preferable to cause the surface of cover 10 to have a hydrophilic property or a hydrophobic property to cause rain and snow to be less likely to stick to the surface of cover 10. Therefore, cover 10 may be made of a material having a hydrophilic property or a material having super water-repellency. Alternatively, it is preferable to cause droplets sticking onto cover 10 to readily flow finely by making the surface of cover 10 rough as being sanded with abrasive paper, or applying wax or the like onto the surface of cover 10.

In addition, a heater 50 heating cover 10 may be provided. For example, coil-shaped heater 50 may be provided to cover 10 in a spiral manner such that a coil interval is not less than 1 cm. With such a configuration, when snow falls on cover 10, the snow on cover 10 can be melted by heating cover 10 with heater 50. This can prevent snow from accumulating on cover 10.

The reason why the coil interval is set to not less than 1 cm is that, since radio waves 7 have a wavelength of about 5 mm, if a coil is provided to have an interval that is not more than the wavelength of radio waves 7, heater 50 may have a function like a spiral antenna and inhibit millimeter wave reception device 2 from receiving radio waves 7.

In the present embodiment, millimeter wave reception device 2 is mounted such that an up-down direction of cover 10 is oriented in a vertical direction and a direction parallel to the upper surface of base member 13 is oriented in a horizontal direction. An apex portion 9*a* and a central portion 9*b* of lens antenna 9 are arranged to be located on an identical straight line in the vertical direction.

Apex portion 9*a* and central portion 9*b* of lens antenna 9 are arranged to be located within the region in which radio waves 7 transmitted from millimeter wave transmission device 1 reach. Further, top portion 10*a* of cover 10 is arranged to be located within the region in which radio waves 7 transmitted from millimeter wave transmission device 1 reach. A region between arrows indicated by two chain double-dashed lines shown in FIG. 2B represents the region in which radio waves 7 reach.

The antenna portion has directivity in a direction in which the radio waves are transmitted/received. In FIG. 2B, a directional region 77 between two chain double-dashed lines is a region in which lens antenna 9 has a high reception sensitivity. Further, apex portion 9*a* of hemispherical lens antenna 9 is a portion determining the directivity described above, that is, an important portion (a vital point) determining gain performance of the antenna portion.

In the present embodiment, top portion 10*a* of conical cover 10 and central portion 9*b* of lens antenna 9 are present within directional region 77 of lens antenna 9. Since top portion 10*a* of cover 10 has a peak shape, this shape can prevent droplets and snow from accumulating or a bird and the like from landing on cover 10 within directional region 77. As a result, cover 10 can eliminate an obstacle inhibiting reception by lens antenna 9 from within directional region 77, and maintain reception performance of lens antenna 9 at a high level.

By arranging the millimeter wave transmission/reception device including millimeter wave transmission device 1 and millimeter wave reception device 2 in positional relationship as described above, reception propagation loss when millimeter wave reception device 2 receives radio waves 7 transmitted from millimeter wave transmission device 1 can be reduced.

Specifically, top portion 10*a* of cover 10 is located above in the vertical direction connecting apex portion 9*a* and central portion 9*b* of lens antenna 9 determining transmission performance of lens antenna 9. Since cover 10 has the shape described above, rain and snow falling on cover 10 are less likely to stick onto cover 10, and a bird, an insect, and the like are also less likely to land on cover 10.

As a result, rain, snow, a bird, an insect, and the like inhibiting reception of radio waves 7 can be eliminated from cover 10, and thus reception propagation loss of radio waves 7 at millimeter wave reception device 2 can be reduced.

Figure 4A:
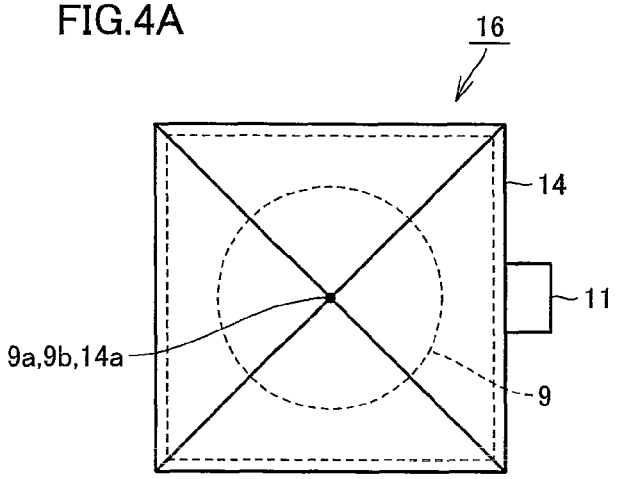
FIG. 4A is a top view schematically showing a structure of a millimeter wave reception device in accordance with a modification of the same embodiment.
Figure 4B:
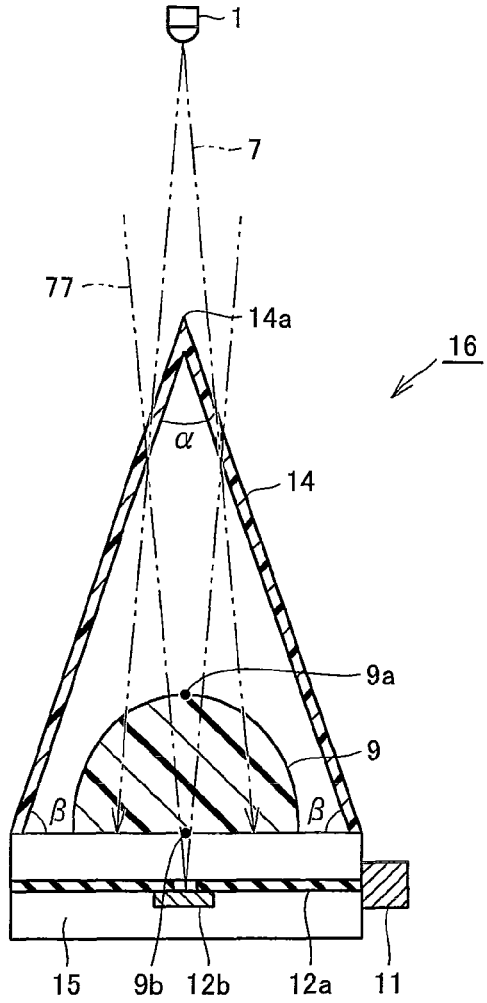
FIG. 4B is a cross sectional view schematically showing the structure of the millimeter wave reception device in accordance with the modification of the same embodiment.
Figure 5:
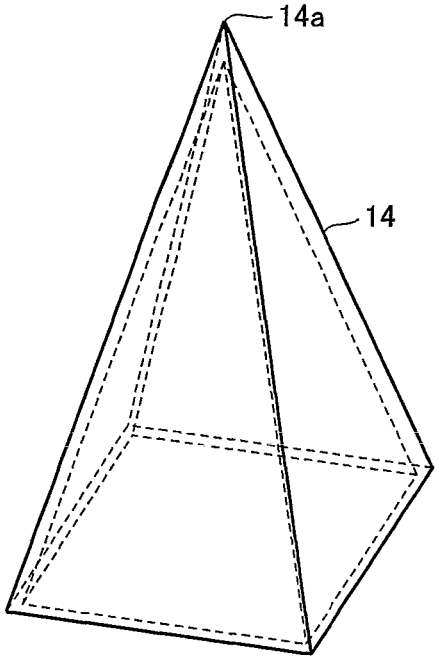
FIG. 5 is a perspective view schematically showing a cover in accordance with the modification of the same embodiment.

FIG. 4A is a top view schematically showing a structure of a millimeter wave reception device in accordance with a modification of the present embodiment. FIG. 4B is a cross sectional view schematically showing the structure of the millimeter wave reception device in accordance with the modification of the present embodiment. In FIG. 4B, for convenience of explanation, millimeter wave transmission device 1 is also shown schematically. FIG. 5 is a perspective view schematically showing a cover in accordance with the modification of the present embodiment.

As shown in FIGS. 4A, 4B, and 5, in a millimeter wave reception device 16 in accordance with the modification, a cover 14 is formed in a hollow quadrangular pyramid shape. To correspond thereto, a base member 15 is formed in a rectangular shape when seen in a plane. Cover 14 has four inclined surfaces.

It is assumed that $\beta$ indicates an angle formed between an inclined surface of cover 14 and an upper surface of base member 15, and $\alpha$ indicates an angle formed between facing inclined surfaces at a top portion 14*a* of cover 14. Since $\beta$ is set to an angle of not less than 60° and not more than 90°, $\alpha$ is not more than 60°. Although top portion 14*a* of cover 14 is pointed in the present embodiment, it may have some roundness.

Central portion 9*b* of lens antenna 9 and top portion 14*a* of cover 14 are arranged to be located within the region in which radio waves 7 transmitted from millimeter wave transmission device 1 reach. Specifically, top portion 14*a* of cover 14 is located above in the vertical direction connecting apex portion 9*a* and central portion 9*b* of lens antenna 9. Since cover 14 has the shape described above, rain and snow falling on cover 14 are less likely to stick onto cover 10, and a bird, an insect, and the like are also less likely to land on cover 14.

As a result, rain, snow, a bird, an insect, and the like inhibiting reception of radio waves 7 can be eliminated from cover 14, and thus reception propagation loss of radio waves 7 at millimeter wave reception device 16 can be reduced.

Although cover 14 having a hollow quadrangular pyramid shape has been described in the modification, cover 14 may have another hollow pyramid shape such as a hollow triangular pyramid shape. Further, a hemispherical cover may be provided over lens antenna 9, and cover 10, 14 in accordance with the present embodiment may be further provided above the cover. That is, covers may be doubly arranged. With such a configuration, reception propagation loss at millimeter wave reception device 16 can be reduced.

Hereinafter, a millimeter wave reception device, a mounting structure for a millimeter wave reception device, and a millimeter wave transmission/reception device in accordance with Embodiment 2 based on the present invention will be described with reference to the drawings.

Embodiment 2

Figure 6:
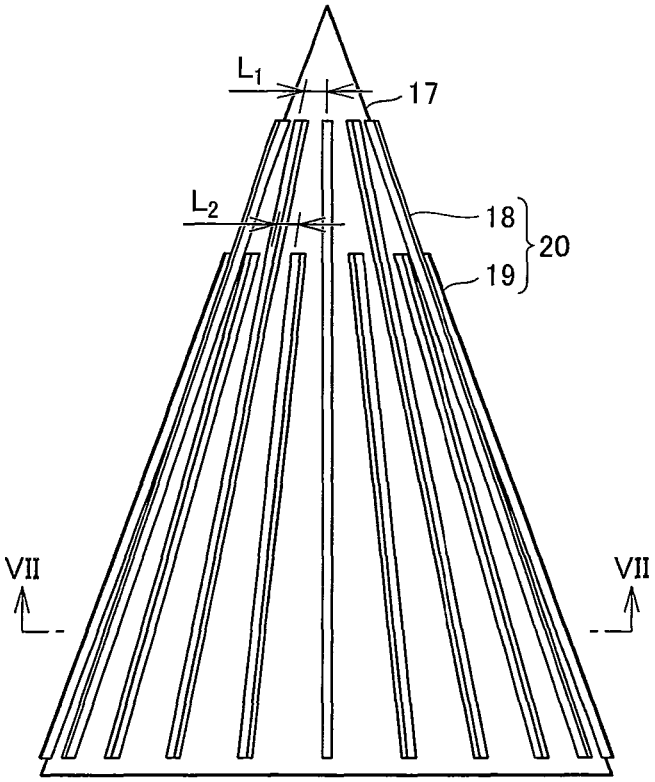
FIG. 6 is a side view schematically showing an outer appearance of a cover in accordance with Embodiment 2 of the present invention.
Figure 7A:
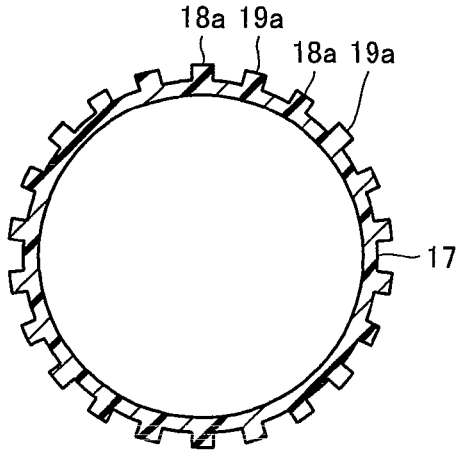
FIG. 7A is a cross sectional view of a cover of the same embodiment taken along a line VII-VII in FIG. 6 and seen in the direction of arrows.
Figure 7B:
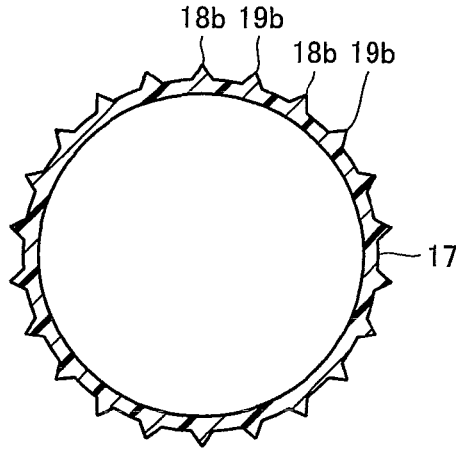
FIG. 7B is a cross sectional view of a cover of a first modification of the same embodiment taken along line VII-VII in FIG. 6 and seen in the direction of arrows.
Figure 7C:
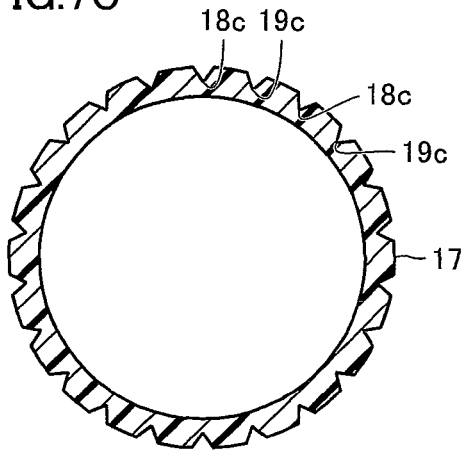
FIG. 7C is a cross sectional view of a cover of a second modification of the same embodiment taken along line VII-VII in FIG. 6 and seen in the direction of arrows.

FIG. 6 is a side view schematically showing an outer appearance of a cover in accordance with Embodiment 2 of the present invention. FIG. 7A is a cross sectional view of a cover of the present embodiment taken along a line VII-VII in FIG. 6 and seen in the direction of arrows. FIG. 7B is a cross sectional view of a cover of a first modification of the present embodiment taken along line VII-VII in FIG. 6 and seen in the direction of arrows. FIG. 7C is a cross sectional view of a cover of a second modification of the present embodiment taken along line VII-VII in FIG. 6 and seen in the direction of arrows.

As shown in FIGS. 6 and 7A to 7C, on an outer surface of a cover 17 having a hollow conical shape, a bifurcation portion 20 in which a first bifurcation portion 18 and a second bifurcation portion 19 are alternately spaced from each other is arranged radially over an entire periphery from a top portion of cover 17 to a foot portion of cover 17. The first bifurcation portion 18 is formed from a position closer to the top portion of cover 17 than the second bifurcation portion 19. The widths of the first bifurcation portion 18 and the second bifurcation portion 19 are set to about 1 mm.

In cover 17 of the present embodiment, as shown in FIG. 7A, the first bifurcation portion 18 is formed of a convex portion 18*a*, and the second bifurcation portion 19 is formed of a convex portion 19*a*. Convex portion 18*a* and convex portion 19*a* have a rectangular cross section.

In cover 17 of the first modification of the present embodiment, as shown in FIG. 7B, the first bifurcation portion 18 is formed of a convex portion 18*b*, and the second bifurcation portion 19 is formed of a convex portion 19*b*. Convex portion 18*b* and convex portion 19*b* have a triangular cross section.

In cover 17 of the second modification of the present embodiment, as shown in FIG. 7C, the first bifurcation portion 18 is formed of a concave portion 18*c*, and the second bifurcation portion 19 is formed of a concave portion 19*c*. Concave portion 18*c* and concave portion 19*c* have a triangular cross section.

By providing bifurcation portion 20 having a cross section described above, surface tension on cover 17 can be reduced to prevent droplets from having a spherical shape. As a result, a liquid sticking to cover 17 readily flows over cover 17. In addition, by causing a liquid such as rain or wet snow sticking to the outer surface of cover 17 to flow from the top portion of the cover to the foot portion of the cover in a bifurcated manner, even a large amount of rain can be caused to flow efficiently in a dispersed manner.

A narrowest interval $L_1$ between the first bifurcation portions 18 adjacent to each other in the vicinity of the top portion of cover 17 is set to about 1 cm. Further, a narrowest interval $L_2$ between the adjacent first bifurcation portion 18 and second bifurcation portion 19 is set to about 1 cm. The intervals are set to prevent occurrence of a state where a liquid such as rain exists across a plurality of bifurcation portions and causes an increase in the surface tension on cover 17, and thereby the liquid is less likely to flow over cover 17. Since a raindrop generally has a diameter of several millimeters, occurrence of the above state can be prevented by setting the interval between the bifurcation portions to not less than about 1 cm.

Figure 8:
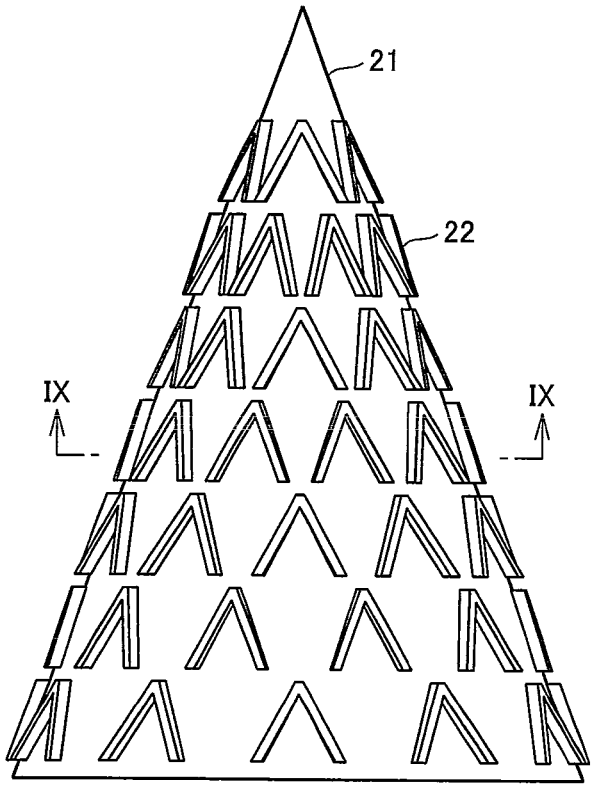
FIG. 8 is a side view schematically showing a cover in accordance with a third modification of the same embodiment.
Figure 9A:
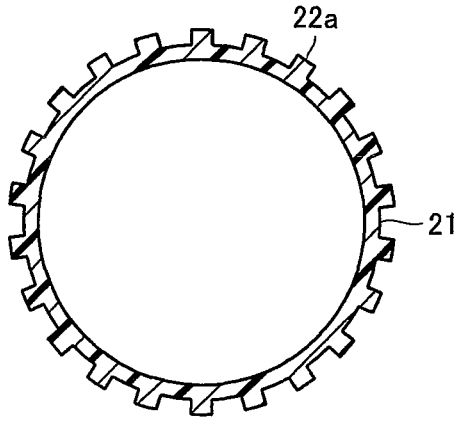
FIG. 9A is a cross sectional view of a cover of the third modification of the same embodiment taken along a line IX-IX in FIG. 8 and seen in the direction of arrows.
Figure 9B:
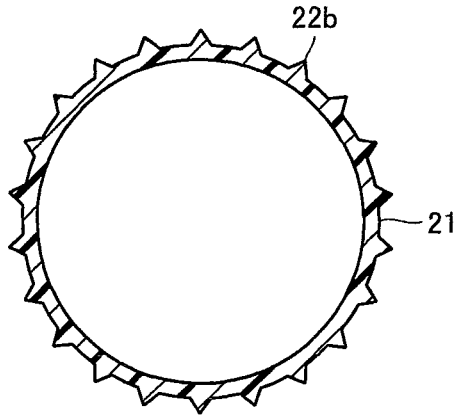
FIG. 9B is a cross sectional view of a cover of a fourth modification of the same embodiment taken along line IX-IX in FIG. 8 and seen in the direction of arrows.
Figure 9C:
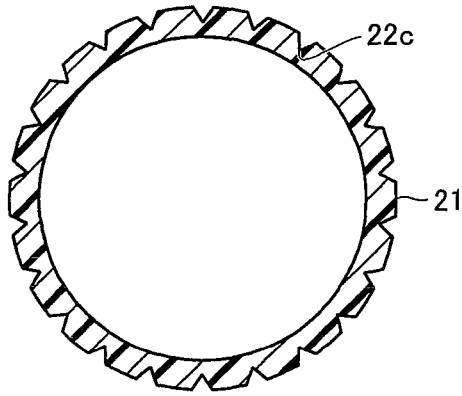
FIG. 9C is a cross sectional view of a cover of a fifth modification of the same embodiment taken along line IX-IX in FIG. 8 and seen in the direction of arrows.

FIG. 8 is a side view schematically showing a cover in accordance with a third modification of the present embodiment. FIG. 9A is a cross sectional view of a cover of the third modification of the present embodiment taken along a line IX-IX in FIG. 8 and seen in the direction of arrows. FIG. 9B is a cross sectional view of a cover of a fourth modification of the present embodiment taken along line IX-IX in FIG. 8 and seen in the direction of arrows. FIG. 9C is a cross sectional view of a cover of a fifth modification of the present embodiment taken along line IX-IX in FIG. 8 and seen in the direction of arrows.

As shown in FIGS. 8 and 9A to 9C, a plurality of bifurcation portions 22 in a Λ-shape are spaced from each other on an outer surface of a cover 21 having a hollow conical shape. The width of bifurcation portion 22 is set to about 1 mm.

In cover 21 of the third modification of the present embodiment, as shown in FIG. 9A, bifurcation portion 22 is formed of a convex portion 22*a*. Convex portion 22*a* has a rectangular cross section.

In cover 21 of the fourth modification of the present embodiment, as shown in FIG. 9B, bifurcation portion 22 is formed of a convex portion 22*b*. Convex portion 22*b* has a triangular cross section.

In cover 21 of the fifth modification of the present embodiment, as shown in FIG. 9C, bifurcation portion 22 is formed of a concave portion 22*c*. Concave portion 22*c* has a triangular cross section.

By providing bifurcation portion 22 having a cross section described above, surface tension on cover 21 can be reduced to prevent droplets from having a spherical shape. As a result, a liquid sticking to cover 21 readily flows over cover 21. In addition, a liquid such as rain or wet snow sticking to the outer surface of cover 21 is bifurcated by Λ-shaped bifurcation portion 22 into two directions. In the present embodiment, bifurcation portion 22 is arranged below each of two ends of Λ-shaped bifurcation portion 22, and the arrangement relationship is repeated from a top portion to a foot portion of the cover.

By causing a liquid to flow from the top portion of cover 21 to the foot portion of cover 21 in a bifurcated manner in succession using bifurcation portion 22 described above, even a large amount of rain can be caused to flow efficiently in a dispersed manner.

The bifurcation portion described above is merely an example, and the shape, arrangement, size, and the like of the bifurcation portion can be modified as appropriate. Any bifurcation portion may be used as long as it is provided on an outer surface of a cover and thereby a liquid sticking to the outer surface of the cover flows from a top portion of the cover to a foot portion of the cover in a bifurcated manner. Since other components are identical to those of Embodiment 1, the description thereof will not be repeated.

Hereinafter, a millimeter wave reception device in accordance with Embodiment 3 based on the present invention will be described with reference to the drawings.

Embodiment 3

Figure 10A:
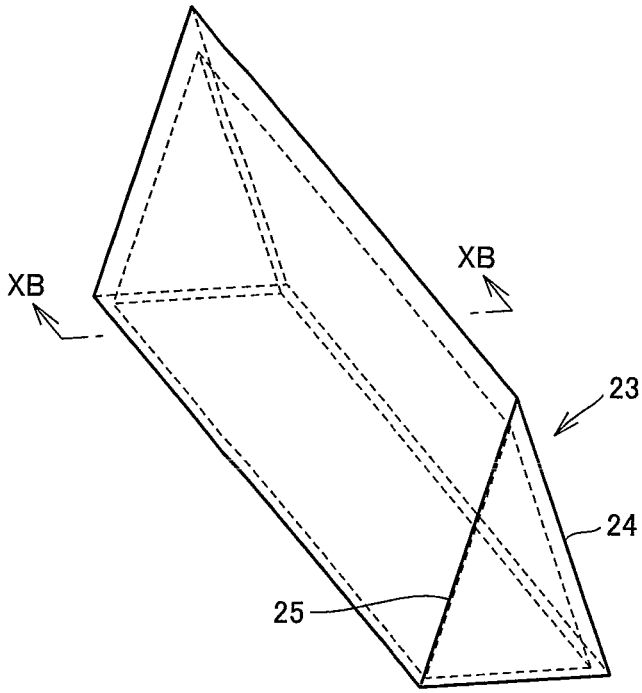
FIG. 10A is a perspective view schematically showing a structure of a cover of a millimeter wave reception device in accordance with Embodiment 3 of the present invention.
Figure 10B:
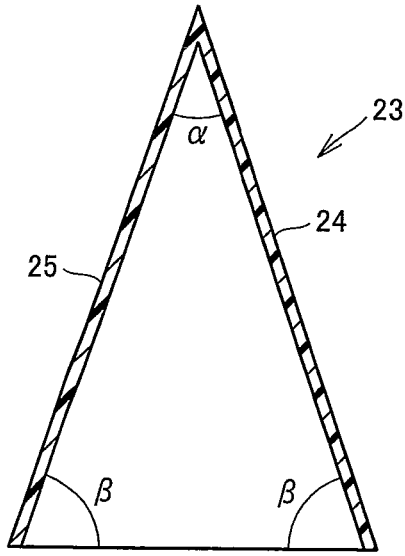
FIG. 10B is a cross sectional view taken along a line XB-XB in FIG. 10A and seen in the direction of arrows.
Figure 11:
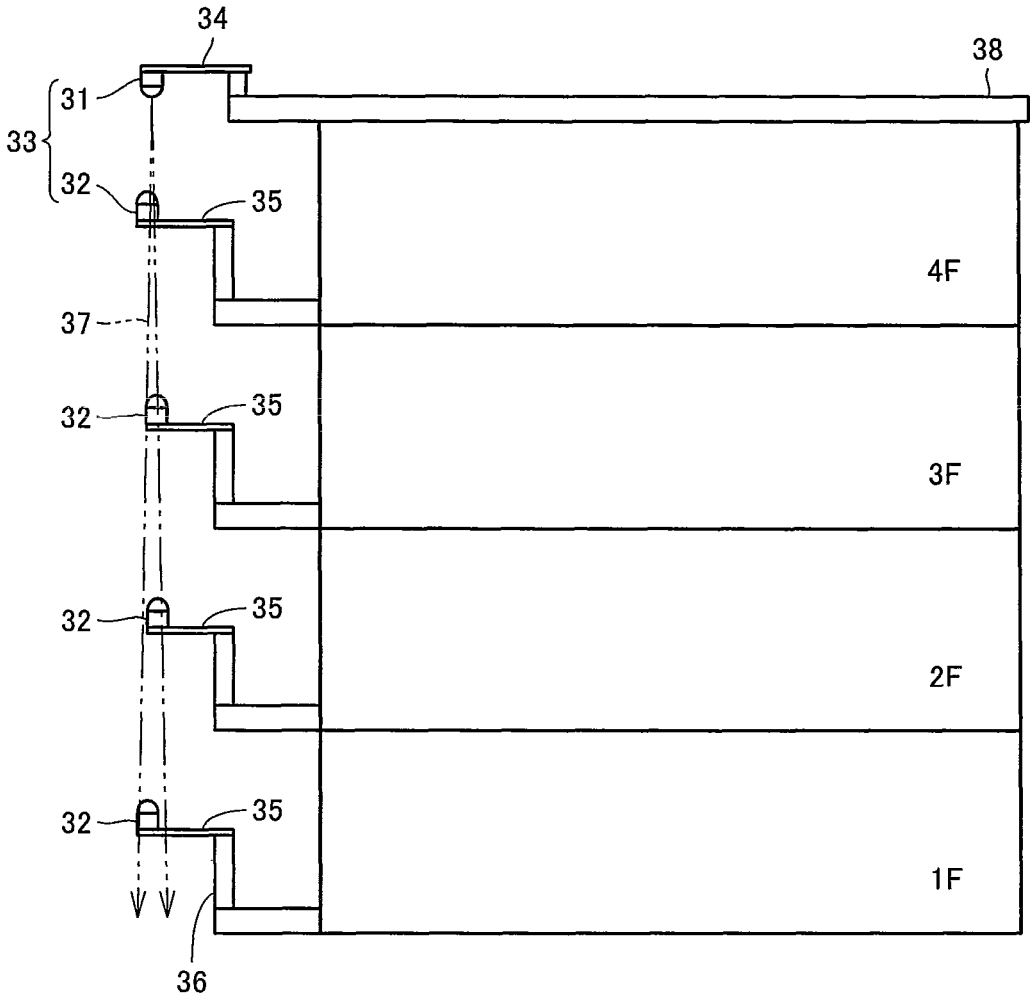
FIG.11 PRIOR ART
FIG. 11 is a view schematically showing a mounting structure for a conventional millimeter wave transmission/reception device.
Figure 12A:
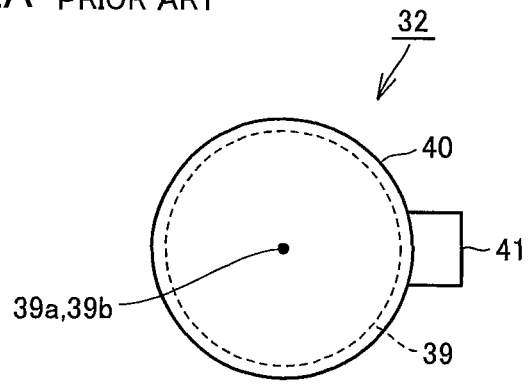
FIG.12A PRIOR ART
FIG. 12A is a top view schematically showing a structure of a conventional millimeter wave reception device.
Figure 12B:
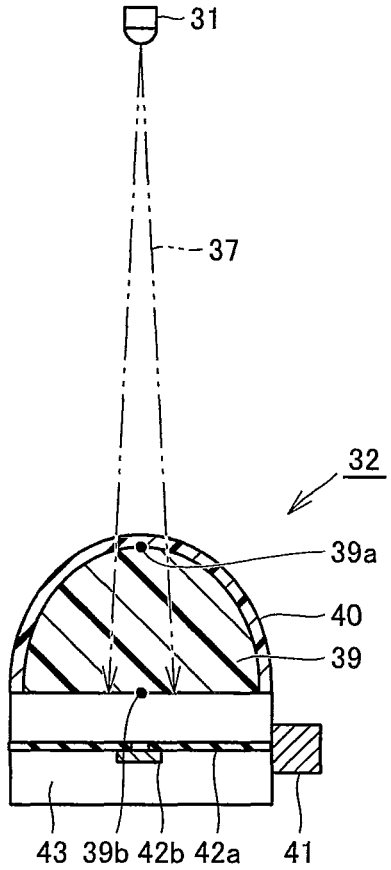
FIG.12B PRIOR ART
FIG. 12B is a cross sectional view schematically showing the structure of the conventional millimeter wave reception device.

FIG. 10A is a perspective view schematically showing a structure of a cover of a millimeter wave reception device in accordance with Embodiment 3 of the present invention. FIG. 10B is a cross sectional view taken along a line XB-XB in FIG. 10A and seen in the direction of arrows. As shown in FIG. 10A, a cover 23 in accordance with Embodiment 3 of the present invention includes two inclined surfaces 24, 25 each formed of a plane, and two side surfaces sandwiched between inclined surface 24 and inclined surface 25.

As shown in FIG. 10B, angle α formed between inclined surface 24 and inclined surface 25 is formed to be not more than 60°. In addition, an angle formed between an upper surface of a base member not shown and each of inclined surface 24 and inclined surface 25 is formed to be not less than 60° and not more than 90°. Although a top portion of cover 23 is pointed in the present embodiment, it may have some roundness.

By providing cover 23 having the above shape, snow falling on cover 23 can readily slide off cover 23. In addition, the top portion of cover 23 has a pointed shape by setting α to be not more than 60°, which can prevent a bird, an insect, and the like from landing on the top portion of cover 23. Since other components are identical to those of Embodiment 1 or 2, the description thereof will not be repeated.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A millimeter wave reception device, comprising:

a base member;

an antenna portion placed on an upper surface of said base member; and a cover arranged above said antenna portion to cover said antenna portion, wherein said antenna portion is formed of a hemispherical lens antenna and arranged within a space formed by said upper surface of said base member and an inner surface of said cover, said cover is formed in a hollow conical shape or a hollow pyramid shape with a top portion having a peak shape, in a tapered shape, and includes not less than one inclined surface having a constant gradient such that said space becomes narrower at a position closer to an upper portion, and an angle formed between an inclined surface of said cover and said upper surface of said base member is not less than 60° and not more than 90°, said top portion of said cover and an apex portion and a central portion of said antenna portion are present within a directional region of said antenna portion, and said top portion of said cover is located above said apex portion and said central portion in a vertical direction connecting said apex portion and said central portion of said antenna portion.

2. The millimeter wave reception device according to claim 1, wherein a bifurcation portion causing a liquid sticking to an outer surface of said cover to flow from a top portion of said cover to a foot portion of said cover in a bifurcated manner is formed on said outer surface of said cover.

3. The millimeter wave reception device according to claim 2, wherein said bifurcation portion in which convex portions or concave portions are spaced from each other is formed on said outer surface of said cover radially over an entire periphery from the top portion of said cover to the foot portion of said cover.

4. The millimeter wave reception device according to claim 2, wherein a plurality of said bifurcation portions in a A-shape in which convex portions or concave portions are spaced from each other are formed on said outer surface of said cover.

5. The millimeter wave reception device according to claim 1, provided with a heater heating said cover.

6. A mounting structure for a millimeter wave reception device, wherein the millimeter wave reception device according to claim 1 is mounted such that an up-down direction of said cover is oriented in a vertical direction and a direction parallel to said upper surface of said base member is oriented in a horizontal direction.

7. A millimeter wave transmission/reception device, comprising:

the millimeter wave reception device according to claim 1; and a millimeter wave transmission device.

8. The millimeter wave transmission/reception device according to claim 7, wherein said antenna portion is formed of a lens antenna, and a central portion of said antenna portion and a top portion of said cover are located within a region in which radio waves transmitted from said millimeter wave transmission device reach.

* * * * *

UNITED STATES PATENT AND TRADEMARK OFFICE

CERTIFICATE OF CORRECTION

PATENT NO. : 8,581,800 B2
APPLICATION NO. : 12/963686
DATED : November 12, 2013
INVENTOR(S) : Eiji Suematsu et al.

It is certified that error appears in the above-identified patent and that said Letters Patent is hereby corrected as shown below:

ON THE TITLE PAGE:

In item (56), References Cited, in the listing of U.S. PATENT DOCUMENTS, delete "2012/0249611 A1 10/2012 Shibata et al.".

In item (56), References Cited, in the listing of FOREIGN PATENT DOCUMENTS, change "JP 2 037 531 A1 3/2009" to --EP 2 037 531 A1 3/2009--.

Signed and Sealed this
Twentieth Day of May, 2014

Michelle K. Lee

Michelle K. Lee
*Deputy Director of the United States Patent and Trademark Office*